United States Patent [19]

Breen et al.

[11] Patent Number: 4,908,599

[45] Date of Patent: Mar. 13, 1990

[54] TEMPERATURE-SENSITIVE RESISTANCE ELEMENT

[75] Inventors: Brian E. Breen, Hunnington; Ian R. Harris, Cannock, both of United Kingdom

[73] Assignee: Lucas Electrical Electronic Systems Limited, England

[21] Appl. No.: 237,665

[22] Filed: Aug. 25, 1988

Related U.S. Application Data

[63] Continuation of Ser. No. 27,526, Mar. 18, 1987, abandoned.

[30] Foreign Application Priority Data

Apr. 1, 1986 [GB] United Kingdom ..... 8607874

[51] Int. Cl.[4] ..... H01C 7/10

[52] U.S. Cl. ..... 338/22 R; 338/308; 338/309; 29/611

[58] Field of Search ..... 338/22 R, 20, 34, 195, 338/308, 309; 374/181; 29/611, 612

[56] References Cited

U.S. PATENT DOCUMENTS

| | | | |
|---|---|---|---|
| 3,935,744 | 2/1976 | Beekman | 374/181 X |
| 4,284,970 | 8/1981 | Berrin et al. | 338/195 |
| 4,343,768 | 8/1982 | Kimura | 338/34 X |
| 4,355,056 | 10/1982 | Dalla Betta et al. | 338/34 X |
| 4,517,545 | 5/1985 | Merz | 338/25 |

FOREIGN PATENT DOCUMENTS

| | | |
|---|---|---|
| 0019135 | 11/1980 | Fed. Rep. of Germany . |
| 57-207835 | 12/1982 | Japan . |
| 0116144 | 8/1984 | Japan . |
| 1415644 | 11/1975 | United Kingdom . |
| 1474731 | 5/1977 | United Kingdom . |
| 1546091 | 5/1979 | United Kingdom . |
| 2068173 | 5/1981 | United Kingdom . |
| 2103804 | 2/1983 | United Kingdom . |
| 2106328 | 4/1983 | United Kingdom . |

*Primary Examiner*—E. A. Goldberg
*Assistant Examiner*—M. M. Lateef
*Attorney, Agent, or Firm*—Andrus, Sceales, Starke & Sawall

[57] ABSTRACT

A temperature-sensitive resistance element comprises an alumina substrate having terminals and a sinuous temperature-sensitive resistance layer thereon. The layer and terminals are formed of electroplated palladium which has been recrystallized.

9 Claims, 1 Drawing Sheet

TEMPERATURE-SENSITIVE RESISTANCE ELEMENT

This application is a continuation of copending application Ser. No. 027,526 filed Nov. 18, 1987 now abandoned.

FIELD OF THE INVENTION

This invention relates to a temperature-sensitive resistance element, and is more particularly concerned with such an element for use in apparatus for monitoring the quantity of combustion air passing through the fuelling system of an internal combustion engine although it can be used, in principle, in apparatus for monitoring any fluid flow.

THE RELATED ART

The monitoring of combustion air flow in the fuelling system of an internal combustion engine is important for the purpose of enabling proper control of the fuelling system. It is known in fuelling systems for internal combustion engines to use a monitoring apparatus in which a pair of temperature-sensitive resistance elements are provided. One of the resistance elements is unheated whilst the other resistance element is heated. The cooling effect produced by air flow over the resistance elements enables the mass flow rate of air to be determined using a d.c. resistance bridge. The two resistance elements are connected as the active elements in opposite arms of the bridge. The heated resistance element is disposed near the center of the duct through which combustion air passes and is heated by a relatively high steady-state current. In accordance with the laws of heat transfer, this heated element makes the fundamental density-velocity measurement as it is cooled by the mass flow in the duct. The unheated resistance element is not significantly affected by the mass flow but it serves to compensate for changes in air temperature by cancelling out any bridge unbalance caused by the air temperature effect on the heated resistance element. It has been known for many years to use a platinum wire coil wound onto an alumina substrate as the temperature-sensitive resistance element. A recent example of this type of sensor is disclosed in EP-A-0116144. However, resistance elements of the wire coil type are difficult to produce with consistent properties and also tend to have a relatively slow response time to changes in the mass flow of combustion air in the fuelling system.

It has also been proposed to use, instead of a platinum wire, a thin or thick film of platinum in a temperature-sensitive resistance element. Thin films of platinum are typically formed by vapour deposition or sputtering but suffer from the disadvantage that it is difficult to obtain a film of uniform thickness. Thus, it is difficult to manufacture sensors having consisent properties. Typical examples of thin film sensors are disclosed in GB 2103804, GB 2106328 and EP 0019135. Thick film sensors are typically those in which the film is produced by printing a mixture of platinum powder and glass powder on a substrate and then firing. This type of process produces a thick platinum film having a temperature coefficient of resistance which approaches that of the pure metal. Other platinum group metals, silver, gold, iron, nickel, cobalt and copper have also been proposed in thick film constructions. However, the disadvantage of a thick film sensor is that it is not particularly easy to adjust the thickness of the layer to suit the particular requirements. Thick film sensors are disclosed, for example, in connection with resistance thermometers in GB-A-1474731, GB 1415644, GB 2068173 and GB 1546091.

An object of the present invention is to provide a temperature-sensitive resistance element which is relatively inexpensive to produce, wherein the thickness of the layer can be controlled easily, and wherein the temperature coefficient of resistance is substantially constant within the desired working range.

SUMMARY OF THE INVENTION

The Applicants have found, surprisingly, that this object can be achieved if the temperature-sensitive resistance film is formed of an electroplated layer of palladium. Thus, according to the present invention, there is provided a temperature sensitive resistance element, comprising an electrically insulating substrate supporting a temperature-sensitive resistance layer, wherein the temperature-sensitive resistance layer is electroplated palladium.

The use of an electroplated platinum film having a thickness of about 1 micrometer is disclosed, for example, in Japanese Patent Application Publication No. 57-207835 for use as the temperature-sensitive region of a platinumrresistance thermometer. However, it is difficult to obtain an electroplated platinum film with consistent properties. This is because platinum plating solutions are erratic in efficiency as a result of the presence in solution of stable 2+and 4+valency ions. The 2+ions oxidize at the anode causing loss in efficiency. The low erratic cathode efficiency of platinum plating solutions make it difficult to conduct fine geometry electroplating, with the result that films having consistent properties are difficult to achieve. Additionally, very highly stressed deposits are obtained when electroplating platinum to thicknesses of 1–2 micrometers and above. Thus, electroplated platinum films of this thickness are very brittle and therefore prone to cracking. It is found that electroplated palladium films with consistent properties can be relatively easily produced because palladium can be plated with high efficiency without anode oxidation and because the required plating thicknesses can be achieved without embrittlement and risk of cracking.

It is per se well known to electroplate palladium but, as far as we are aware, it has never been proposed to use an electroplated palladium layer as a temperature-sensitive resistance region. For example, electroplating of palladium has been previously proposed as a cheaper alternative to gold in the field of electronics and also for the production of coatings on sliding electrical contacts and decorative coatings for ornamental purposes.

Most preferably, the electroplated palladium resistance layer is supported on the substrate through the intermediary of a bonding film. Conveniently, the bonding film comprises a lower layer of an alloy such as a nickel-chromium alloy (e.g NICHROME) having a temperature coefficient of expansion which lies between that of the electroplated palladium layer and that of the electrically insulating substrate. The bonding film may further include a thin film of palladium which has been formed, for example, by sputtering.

Also according to the present invention, there is provided a method of manufacturing a temperature-sensitive resistance element comprising the steps of providing on an electrically insulating substrate an electrically conducting film which adheres to said substrate, providing an electroplated palladium layer having the desired pattern on said electrically conductive film, and then heat treating the electroplated palladium layer at a temperature such as to recrystallise the palladium.

Conveniently, heat treatment is effected at a temperature of at least 800° C. for at least 30 minutes in an inert atmosphere, e.g an inert gas such as argon or nitrogen. By the term "inert gas" is meant a gas which does not react with the palladium at the temperature of heat treatment so that the palladium remains in a pure state. After heat-treatment, cooling is preferably effected in the same inert atmosphere.

Most conveniently, the method is effected by image-wise electroplating of the palladium using a mask, demasking and removing, e.g by back sputtering, the electrically conducting intermediate film in the areas exposed by the demasking.

The intermediate film is typically constituted by a lower film of a nickel/chromium alloy which is in intimate contact with the substrate and which has a typical thickness of 0.003 micrometers, on which is provided a film of palladium (typically 0.3 micrometers thick) produced by, for example, sputtering.

The substrate employed is typically alumina, although other suitably heat resistant material may be employed. The substrate may be of any desired shape e.g plate-like, tubular or cylindrical.

The thickness of the electroplated palladium layer for a given size of element will vary depending upon the overall resistance required. However, typically, the palladium layer will have a thickness of 2 to 2.5 micrometers. Preferably, the palladium layer has a thickness of 2 micrometers.

The above method enables well established masking technology to be used to produce an electroplated palladium layer in the required pattern.

Typically, the palladium layer which is electroplated has a meandering or sinuous form so that the required resistance can be obtained within a short length of substrate. The method of the present invention avoids having to use cutting techniques, for example laser cutting techniques, for producing the required shape from a previously electrodeposited palladium layer. However, it is within the scope of the present invention to utilize a relatively simple laser trimming operation to effect fine tuning of the resistance of the layer after electroplating and removal of the photoresist by cutting through one or more webs formed in the electroplated layer between adjacent portions thereof, said webs being mutually arranged electrically in parallel so that removal of one or more of the webs can be effected to increase the overall resistance of the electroplated layer as necessary.

Also according to the present invention, there is provided an air flow meter comprising an electrically insulating support carrying a temperature-sensitive resistance layer formed of electroplated palladium.

BRIEF DESCRIPTION OF THE DRAWING

An embodiment of the present invention will now be described, by way of example, with reference to the accompanying drawings, in which.

DESCRIPTION OF THE PREFERRED EMBODIMENT

Figure 1:
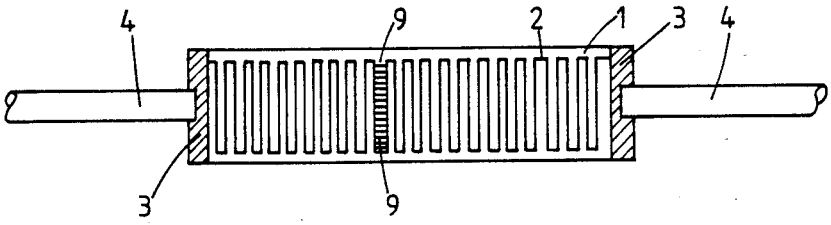
FIG. 1 is a schematic plan view of a temperature sensitive resistance element according to the present invention.
Figure 2A:
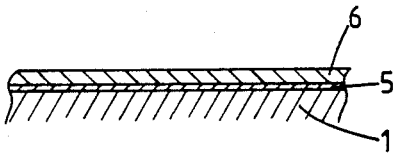
FIGS. 2*a* to 2*b* are schematic views illustrating steps which are effected in order to produce the element of FIG. 1.
Figure 2B:
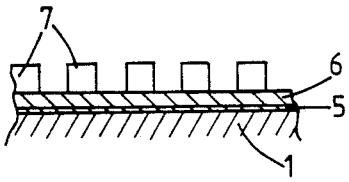
Figure 2C:
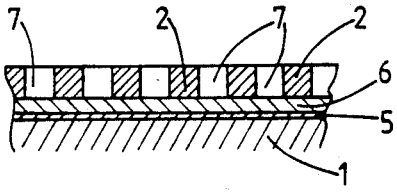
Figure 2D:
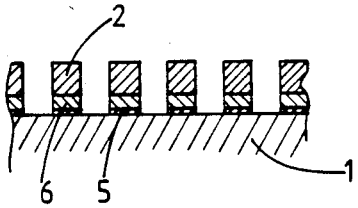

Referring now to FIG. 1, the temperature sensitive resistance element is for use in an air flow meter of a fuelling system for an internal combustion engine to enable, in a manner known per se, the amount of combustion air being passed to the engine at any instant to be monitored. Typically, the element is intended to be used in place of the platinum wire resistance elements disclosed in EP-A-0116144. The element comprises a flat alumina substrate 1 having a length of 2 millimeters, a width of 0.5 mm and a thickness of 0.25 mm. It is, however, within the scope of the present invention to use other ceramic materials for the substrate provided that such ceramic materials are suitably heat resistant to the heat treatment process to be described hereinafter and to the conditions in service. The alumina substrate 1 need not be flat as illustrated in the drawing but may be of any desired shape, including tubular and solid cylindrical. Supported on one surface of the substrate 1 is a sinuous heat-sensitive resistance track 2 which is formed of electroplated palladium. At each end of the substrate 1, there is provided a terminal 3 which is integrally formed with the track 2 from electroplated palladium. Leads 4 which are formed of gold or of an alloy of rhodium and platinum and which have a diameter of 0.2 mm, are welded or bonded to the terminals 3. The electroplated palladium of the track 2 has a thickness, in this embodiment, of two micrometers and is bonded to the substrate 1 through the intermediary of a film 5 of an alloy of nickel and chromium having a thickness of 0.003 micrometers which is directly in contact with the substrate, and a sputtered thin film 6 of palladium having a thickness of 0.3 micrometer disposed between the electroplated palladium tracks 2 and the nickel/chromium alloy film 5. In this embodiment, the sinuous electroplated palladium track 2 has a width of 25 micrometers, the spacing between the tracks also being 25 micrometers. The resistance of the resistance element is 20 ohms at ice point and the temperature coefficient of resistance thereof between 0° and 100° C. is substantially linear, being at least 3500 ppm/° C.

Referring now to FIGS. 2(*a*) to 2(*d*) the above described heat sensitive resistance element is produced by first sputtering film 5 of nickel/chromium alloy (NICHROME) 0.003 micrometers thick onto the substrate 1. Following this, film 6 of palladium 0.3 micrometer thick is sputtered onto the film 5 (see FIG. 2*a*).

Following this, a layer of photoresist to define a mask 7 is provided on the sputtered palladium film 6. This mask 7 is provided by depositing a continuous layer of negative photoresist, in this embodiment, of the cyclised polyisoprene type. The layer of photoresist is then image-wise exposed to light, followed by removal of the light exposed areas using as a solvent, and then drying or baking.

Following this, the heat sensitive resistance layer 2 is formed by electroplating palladium. In this embodiment, the substrate 1 with fine line exposed photoresist areas is mounted in a quartz boat and plasma etched in an oxygen plasma at a reduced atmospheric pressure of 1.5 torr to obtain a clean surface.

The clean substrate is electroplated in a neutral to alkaline palladium solution consisting of palladium ammonium chloride, ammonium phosphate and ammonium hydroxide to pH 7.5 at 50° C. using a pulsed periodic reverse current at a density of 0.4 amp $dm^2$ using a platinised anode.

To facilitate the formation of a palladium layer having a dense crystal structure, within the fine line exposed photoresist areas, it is necessary to modify the plating current to minimise polarisation effects in the plating bath. This is achieved with the aid of pulse periodic reverse equipment at the following settings:

Plating on time of 1000 milliseconds, duty cycle of 80%, at a frequency of 20 Hz and a plating off time of 100 milliseconds, duty cycle of 80% and a frequency of 20 Hz. The resultant electroplated palladium layer has a thickness of 2 micrometers.

The photoresist layer 7 is removed using a chemical stripper of the alkyl sulphonic acid type in a high boiling point solvent. Then the portions of the nickel/-chromium alloy and sputtered palladium films 5 and 6 were removed by back sputtering so as to leave the substrate surface exposed between the tracks 2 of the electroplated palladium layer. The above-described operation also produces the terminals 3 (not shown in FIGS. *2a* to *2d*).

The whole assembly is then heat treated by annealing at 800° C. for half an hour in an atmosphere of pure argon, followed by cooling in the same atmosphere. This operation serves to recrystallise the palladium so as to obtain electrical resistance properties which are similar to that of the bulk metal. The leads 4 are then bonded or welded to the terminals 3.

Finally, the assembly including the joints between the terminals 3 and the leads 4 is covered with a protective layer, in this embodiment non-vitreous glass by coating with particles of glass in a slurry and then fusing at a temperature of 580° C.

The resultant element has a small thermal mass and a fast response time (about 40 milliseconds), and a high temperature coefficient of resistance (at least 3500 ppm/°C.). The element is physically robust and can withstand handling and the conditions which arise in service, and is resistant to attack by corrosion. The actual resistance of the electroplated palladium layer can be trimmed so as to increase the resistance thereof by cutting through one or more of a plurality of webs 9 (see FIG. 1) which are integrally formed with the track 2 and which interconnect adjacent portions of the track 2 electrically in parallel. Cutting is conveniently effected by means of a laser. The above described operation is relatively easy and economic to effect and is suitable for automation. Very small resistance elements can be fabricated and the overall resistance thereof can be readily adjusted by altering the plating time. The photolithographic technique used for producing the required shape of the electroplated layer permits a sinuous track 2 with very closely spaced apart portions to be produced, thereby enabling the size of the element to be reduced.

In the above described embodiment, the track 2 provided on one side only of the substrate. However, it is within the scope of the invention to provide tracks of electroplated palladium on both sides of the substrate. The tracks 2 may be of any desired pattern.

We claim:

1. A temperature-sensitive resistance element, comprising an electrically insulating substrate supporting a temperature-sensitive resistance layer wherein said temperature-sensitive resistance layer is recrystallised electroplated palladium.

2. An element as claimed in claim 1, further comprising a pair of terminals to which said resistance layer is electrically connected, and a lead connected to and extending from each terminal.

3. An element as claimed in claim 1, wherein said electroplated palladium resistance layer is supported on said substrate through the intermediary of a bonding film.

4. An element as claimed in claim 3, wherein said bonding film comprises a layer of an alloy having a temperature coefficient of expansion which lies between that of said electroplated palladium layer and that of said electrically insulating substrate.

5. An element as claimed in claim 4, wherein said bonding film further includes a thin film of palladium which is disposed between said electroplated palladium layer and said alloy layer.

6. A method of manufacturing a temperature-sensitive resistance element characterised by the steps of providing on an electrically insulating substrate an electrically conducting film which adheres to said substrate, providing an electroplated palladium layer having the desired pattern on said electrically conductive film and then heat treating said electroplated palladium layer at a temperature such as to recrystallise the palladium.

7. A method as claimed in claim 6, wherein said heat treatment is effected at a temperature of at least 800° C. for at least 30 minutes in an inert atmosphere.

8. A method as claimed in claim 6, wherein said electroplated palladium layer is provided by image-wise electroplating of the palladium using a mask, demasking, and removing the electrically conducting intermediate film in the areas exposed by the demasking.

9. A method as claimed in claim 6, wherein the palladium layer is produced with a meandering or sinuous form and a plurality of webs mutually arranged in parallel, said webs extending between adjacent portions of the meandering or sinuous form and being mutually arranged electrically in parallel so that, by selective cutting of one or more of the webs, the overall resistance of the electroplated layer can be increased.

* * * * *